United States Patent [19]

Landa

[11] 4,233,381

[45] Nov. 11, 1980

[54] METHOD AND APPARATUS FOR INCREASING THE APPARENT RESOLUTION OF DEVELOPED ELECTROPHOTOGRAPHICALLY REPRODUCED IMAGES

[75] Inventor: Benzion Landa, Edmonton, Canada

[73] Assignee: Savin Corporation, Valhalla, N.Y.

[21] Appl. No.: 958,979

[22] Filed: Nov. 9, 1978

[51] Int. Cl.[2] ..... G03G 13/22

[52] U.S. Cl. ..... 430/33; 430/126; 430/35; 430/45; 355/3 TR

[58] Field of Search ..... 96/1.4, 1 LY, 1 R; 427/16, 24; 355/10, 3 TR; 430/33, 126, 3 S, 4 S

[56] References Cited

U.S. PATENT DOCUMENTS 3,707,138 12/1972 Cartwright ..... 427/24

FOREIGN PATENT DOCUMENTS 2219005 4/1972 Fed. Rep. of Germany ..... 96/1 R

*Primary Examiner*—John D. Welsh

*Attorney, Agent, or Firm*—Shenier & O'Connor

[57] ABSTRACT

My invention comprises charging a photoconductive surface in the dark and exposing it to a light and shade image of the original to produce a latent electrostatic image. The latent electrostatic image is then developed by any method known to the art employing a liquid developing fluid, and the apparent resolution or sharpness of the developed image is increased by exposing the developed image, while on the photoconductor, to the action of blanket light. The sharpened image may then be transferred to a carrier sheet by any method known to the art.

The apparatus of my invention comprises a conventional electrophotographic reproduction apparatus in which a means is provided for subjecting a liquid-developed image, while on the photoconductor, to the action of blanket light. This means is positioned to act before the liquid-developed image is transferred to a carrier sheet after it has been developed, if a transfer is to take place.

3 Claims, 2 Drawing Figures

METHOD AND APPARATUS FOR INCREASING THE APPARENT RESOLUTION OF DEVELOPED ELECTROPHOTOGRAPHICALLY REPRODUCED IMAGES

CROSS-REFERENCE TO RELATED APPLICATION

In my copending application, Ser. No. 908,355, filed May 22, 1978, I have disclosed an improved method of electrophotography and apparatus for practicing the same which enables me to increase the effective speed of a photoconductor in response to visible light. In the instant application, I disclose a related method and apparatus for increasing the apparent resolution or sharpness of an image which is developed by a liquid developer, that is, one comprising mobile toner particles which remain mobile in the transferable liquid-developed image.

BACKGROUND OF THE INVENTION

As in all fields of graphic reproduction, the resolution or sharpness of the edge of an image is important. The optical image to which a charged photoconductor is exposed can be made quite sharp by the use of a lens system of high resolving power. The degree to which a photoconductor can retain the latent electrostatic image formed by the exposing step depends upon the composition and nature of the particular photoconductor. For purposes of illustration, I will assume blurred electrostatic images occur either because the original is blurred or as an incident of the exposing step of the reproduction process. The measurement of the resolution of the system, that is, the optics and the photoconductor, can be measured in terms of percentage modulation transfer function. My method and apparatus increase the percentage modulation for all frequencies below the upper frequency limit of the system. This is especially apparent when a blurred original is being reproduced.

FIELD OF THE INVENTION

My invention relates to a novel method of increasing the sharpness of a developed latent electrostatic image on a photoconductor and an apparatus for carrying out the method.

DESCRIPTION OF THE PRIOR ART

The following art has been considered in respect of or is referred to in this specification:

| | |
|---|---|
| Steinhilper | Patent 2,756,676 |
| Hayashi et al | Patent 3,907,423 |
| Brooke | Patent 3,912,387 |
| Brooke | Patent 3,994,723 |

Steinhilper proposes to make multiple copies of an image from a single light exposure of the original. To do this, he recharges the photoconductor after each transfer of the developed image and enhances the recharged image by subjecting it to illumination. This enhanced image is then developed by a powdered developer and transferred to a carrier sheet. There is no teaching, in Steinhilper, of increasing the sharpness of the developed image after it has been developed and before it has been transferred. Since Steinhilper employs a dry powder toner, there can be no image sharpening effect such as achieved by my invention, in which a liquid developer is used, and in which the toner particles are mobile in the transferable liquid-developed image.

Hayashi et al show a reverse roller designed to remove excess developing liquid from the photoconductor after the image has been developed. My process requires that the toner particles are mobile, and hence the use of a liquid developer.

Brooke U.S. Pat. No. 3,912,387 and its divisional U.S. Pat. No. 3,994,723 show detecting background areas which are underexposed and discharging them by light before the development of the latent electrostatic image. In my invention, the exposure to blanket light must take place after development of the latent electrostatic image.

SUMMARY OF THE INVENTION

One object of my invention is to provide a method of increasing the sharpness of electrophotographically reproduced images after they have been developed but before they have been transferred to a carrier sheet.

Another object of my invention is to provide a novel apparatus for carrying out my improved method of increasing the apparent resolution of developed electrophoto reproduced images.

Other and further objects of my invention will appear from the following description.

BRIEF DESCRIPTION OF THE DRAWINGS

In the accompanying drawings, which from part of the instant specification and which are to be read in conjunction therewith.

DESCRIPTION OF THE PREFERRED EMBODIMENT

In general, my invention comprises the employment of any conventional electrophotographic apparatus in which the photoconductor is charged and then exposed to a light and shade image of the original to form a latent electrostatic image on the photoconductor. This image is then developed by any method known to the art, employing a liquid developer comprising toner particles in a liquid vehicle. The developed image comprises deposits of toner particles still mobile on the photoconductor. The developed image may often exhibit a degree of degradation at the edges of the charged areas of the image, owing to a blurred original or aberrations in the focusing of the optical system. After the image has been developed but before it is transferred to a carrier sheet, if a transfer is to be made, the photoconductor bearing the liquid-developed electrostatic image is subjected to blanket light to further discharge the background areas of the photoconductor. Since the density of the deposit of toner in the areas adjacent the maximum density is comparatively slight, some light will be transmitted through the lightly toned areas to further discharge the photoconductor in these areas. The reduction of the electrostatic charge frees the lightly attached and mobile toner particles. They will then be attracted to the more highly charged adjacent areas, thus removing the edge fuzziness and sharpening the image, that is, giving it better apparent resolution.

The apparatus for carrying out my method comprises placing a source of blanket light in the path of the moving photoconductor, bearing a developed electrostatic image, after the image has been developed but before transfer, if transfer to a carrier sheet is to be made. If a sheet coated with a photoconductor is used, there will be no transfer to a carrier sheet.

Figure 1:
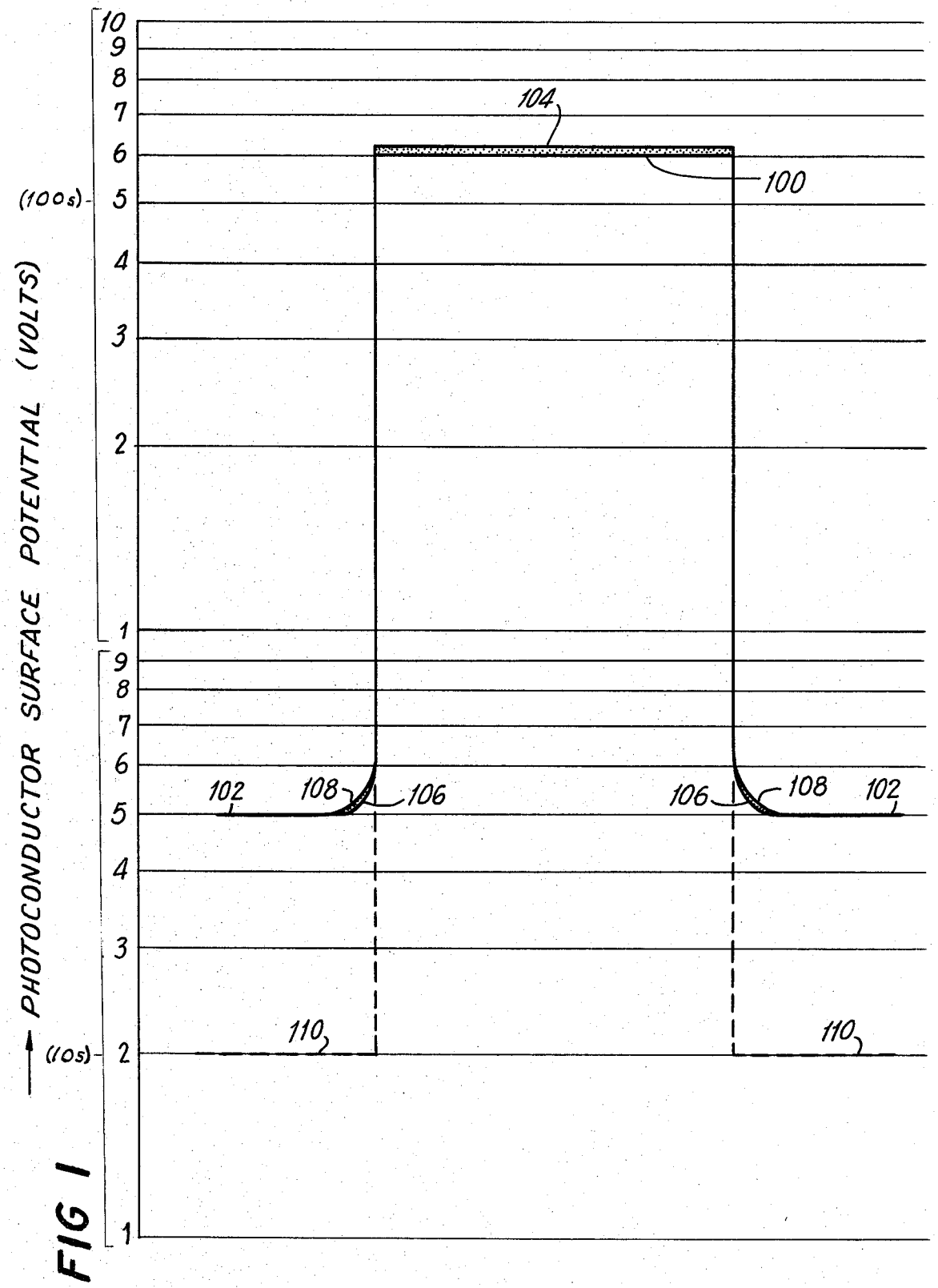
FIG. 1 is a diagrammatic view showing the potential on the photoconductor after it has been exposed, which indicates, in full lines, the disposition of the toner after the latent electrostatic image has been developed, and which shows, in broken lines, the potential on the surface of the photoconductor after the resolution of the developed image has been increased by my method, plotted with logarithmic ordinates.

More particularly, referring now to FIG. 1, I have shown a chart plotted with logarithmic ordinates, showing diagrammatically the disposition of toner on a latent electrostatic image after it has been developed. This disposition is shown in full lines. The chart also shows an example of a potential on the photoconductor after the developed image has been exposed to blanket light. In FIG. 1, the region indicated generally by the reference numeral 100 represents an image area of a photoconductor charged to 600 volts. Background areas, that is, those outside the edges of the image, represented by the reference numeral 102, have been discharged by blanket light to a potential of 50 volts. The layer 104 represents a deposition of toner on the image area 100. The edge areas which are blurred are characterized by a voltage gradient indicated by solid line 106. These areas will be lightly toned with a deposition of toner indicated by the reference numeral 108.

When the image thus developed is subjected to blanket light, the background areas will be reduced in voltage, say, for example, to 20 volts, as shown by the broken-line areas 110. It will be observed that the lightly held toner portions 108 have disappeared, owing to the fact that the particles therein become disengaged from the areas in which the voltage has been reduced by illumination. The freed toner particles will pass to the image area 100 owing to the presence of the charge on the image areas and the mobility of the toner particles in the liquid-developed image.

Figure 2:
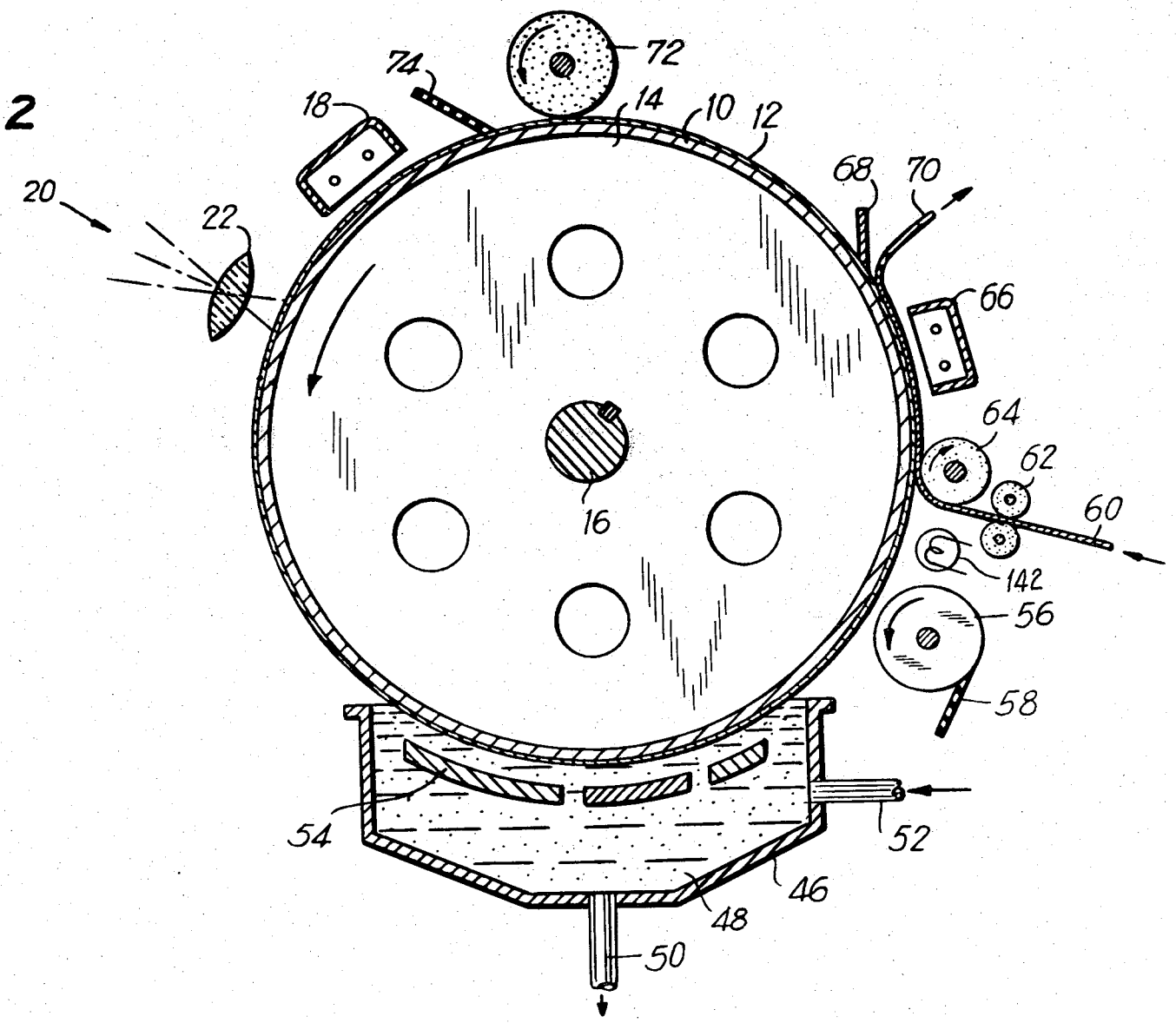
FIG. 2 is a diagrammatic view showing one form of apparatus capable of carrying out my invention.

Referring now to FIG. 2, conventional apparatus for carrying out my invention comprises a metal drum 10, which carries a photoconductive layer 12, which may be selenium. The metal drum 10 is supported by apertured disks 14 which are mounted on a shaft 16 and keyed thereto for rotation therewith. The shaft 16, which may be grounded, is driven by any appropriate means known to the art to rotate the drum 10 in the direction of the arrow. A charging corona 18 is adapted to charge the surface of a photoconductor, as, for example, the selenium photoconductor 12, to a voltage of between 800 and 1000 volts. To accomplish this, the charging corona is energized to a positive potential of 5000 or 6000 volts, The elements of the corona discharge unit cause ionization of the circumambient atmosphere and place a uniform positive charge over the surface of the selenium. It will be understood that, if a zinc oxide photoconductor is used, the charge will be negative, that is, of electrons. The photoconductor 12 is then carried past the exposure station indicated generally by the reference numeral 20. Projection optics, indicated diagrammatically by the lens 22, project an image of the original to be copied upon the photoconductor 12.

After the photoconductor has been exposed, I develop the latent image by use of a liquid-carried toner, preferably by the toning system described in Schaefer et al U.S. Pat. No. 3,892,481, employing a tank 46 from which a liquid toner 48 circulates from pipe 50 to a toner supply tank (not shown) and back through pipe 52 to the tank 46. A development electrode 54 is controlled to bias any residual voltage left on the background of the photoconductor. This bias is such that is is slightly above the potential of the background areas 102. Accordingly, the background areas will not be toned, since toner particles will migrate to the development electrode and not to the background areas.

After development with the liquid-carried toner, a reverse roller 56, such as shown in Hayashi et al U.S. Pat. No. 3,907,423, is positioned to remove excess developer liquid from the developed image. The reverse roller 56 is provided with a wiper 58. The reverse roller 56 is positioned and rotates at speeds as described in the Hayashi et al patent.

In the processes of the prior art where there is transfer of the developed image, the image is now ready to be transferred to a carrier sheet such as plain paper. If a paper coated with a photoconductor is used, there may be no transfer. In my process and apparatus, I position an illumination means such as an incandescent lamp 142 after the development station and, if there is transfer of the developed image, between the development station and the developed-image transferring station. This lamp 142 floods the developed image with light, reduces the background voltage, and thus frees the loosely held toner particles adjacent the edges of the image for migration toward the more highly charged areas of the image. This illumination performs the image-sharpening step and increases the apparent resolution of the image.

As shown in FIG. 2, after the image-sharpening step, a plain paper sheet 60 is fed by rollers 62 to a roller 64, past a transfer-charging corona 66. It will be recalled that the toned imaged still comprises a visible image over the high positive charge on the surface of the selenium drum corresponding to the latent electrostatic image of the original document being reproduced. To transfer the developed image from the drum to the paper carrier sheet, a high positive charge is applied to the back of the copy paper. As a result of the application of the high positive charge to the sheet, the toner particles are pulled from the drum surface onto the paper. If an adhesive toner is used, the transfer may be by pressure between the roller 64 and the surface 12. A pick-off 68 ensures that the paper leaves the drum, and the end of the paper 70, now carrying the image, may be dried and passed to a receiving tray (not shown). A cleaning roller 72 wipes the drum clean of any particles of toner which have not been removed from the drum, and a wiper blade 74 completes the drum-cleaning operation.

As will be seen by reference to FIG. 2, I introduce an incandescent lamp 142 or any other appropriate means of blanket illumination adjacent the photoconductor 12, which now bears a developed image but which image has not yet been transferred, between the development station and the transfer station. This incandescent lamp serves to further discharge edge areas which are thinly toned and to disengage those lightly held particles at the toned edges which make the fuzziness of the developed image visible.

It will be seen that I have accomplished the objects of my invention. I have provided a method and apparatus for increasing the apparent resolution of developed electrophotographically reproduced images so that the transferred image possesses increased sharpness. My apparatus is quite simple in that it comprises introducing a means for flooding the developed image, while on the photoconductor, with light between the development station and the transfer station of a conventional electrophotographic apparatus. My method can be applied to existing photocopying machines by retrofitting the same with an illumination means as described in my invention. My invention is particularly applicable in making electrophotographic copies of original documents which are slightly out of focus or of carbon copies, poorly printed materials, and the like, on which the edges of the characters are blurred.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In a method of electrophotography in which a photoconductor is charged in a charging step, subjected to a light and shape image of a document to be copied to produce a latent electrostatic image of the document on the surface of the photoconductor in an exposing step, the latent electrostatic image is developed by a liquid-carried toner to provide a visible image on the photoconductor in a development step, and the visible image is transferred to a carrier sheet after it has been developed in a transferring step, the improvement comprising flooding the front of the visible electrostatic image with blanket light to increase the apparent resolution of the developed image before it is transferred to a carrier sheet and then practicing the transferring step.

2. An improved method of electrophotography including the steps of forming a latent electrostatic image of an original to be copied on the surface of an electrostatically charged photoconductor and toning the said latent electrostatic image with a liquid-carried toner to develop the same, the improvement comprising increasing the apparent resolution of the developed electrostatic image by subjecting the front of the same to the action of a blanket of light and then transferring the developed image having increased resolution to a carrier sheet.

3. In an apparatus for making copies of a document by electrophotography having a photoconductor; means for charging the photoconductor; exposing means for subjecting the charged photoconductor to a light and shade image of the document being copied to form a latent electrostatic image; means for developing the latent electrostatic image with a liquid developer; means for transferring the developed image to a carrier sheet; and means for moving the photoconductor past the charging means, the exposing means, the developing means, and the transferring means in succession; the improvement comprising interposing a light source for flooding the front of the developed electrostatic image on the photoconductor with light between the developing means and the transferring means.

* * * * *

UNITED STATES PATENT AND TRADEMARK OFFICE

CERTIFICATE OF CORRECTION

PATENT NO. : 4,233,381

DATED : November 11, 1980

INVENTOR(S) : Benzion Landa

It is certified that error appears in the above-identified patent and that said Letters Patent are hereby corrected as shown below:

Column 5, line 23, "shape" should read -- shade --.

Signed and Sealed this

*Tenth* Day of *February 1981*

[SEAL]

*Attest:*

RENE D. TEGTMEYER

*Attesting Officer*

*Acting Commissioner of Patents and Trademarks*